United States Patent [19]

Pryor

[11] Patent Number: 4,477,262

[45] Date of Patent: Oct. 16, 1984

[54] MIXER FOR CUTTING TORCH

[75] Inventor: David A. Pryor, Denton, Tex.

[73] Assignee: Victor Equipment Company, Denton, Tex.

[21] Appl. No.: 494,882

[22] Filed: May 16, 1983

[51] Int. Cl.[3] ..... B01F 5/00

[52] U.S. Cl. ..... 48/180R; 48/192; 239/426; 239/434

[58] Field of Search ..... 48/180.1, 189.1, 189.3, 48/189.4, 192; 239/426, 434; 266/48; 431/346

[56] References Cited

U.S. PATENT DOCUMENTS

| | | | |
|---|---|---|---|
| 1,262,351 | 4/1918 | Jones et al. | 239/400 |
| 1,276,893 | 8/1918 | Fischer | 239/132.3 |
| 1,516,078 | 11/1924 | Buckman | 48/180.1 |
| 1,846,743 | 2/1932 | Mandeville | 239/434 |
| 1,882,420 | 10/1932 | Harmmon | 48/180.1 |
| 1,935,167 | 11/1933 | Thomas | 431/346 |
| 1,994,841 | 3/1935 | Thomas | 48/180.1 |
| 2,198,342 | 4/1940 | Jacobson et al. | 158/27.4 |
| 2,263,655 | 11/1941 | Stettner | 285/123 |
| 2,371,970 | 3/1945 | Marra | 158/27.4 |
| 2,520,001 | 8/1950 | Eicher | 239/424.5 |
| 3,091,281 | 5/1963 | Clark | 158/27.4 |
| 4,022,441 | 5/1977 | Turney | 266/48 |
| 4,248,384 | 2/1981 | Zwicker | 239/419.3 |

*Primary Examiner*—Peter F. Kratz
*Attorney, Agent, or Firm*—Wofford, Fails & Zobal

[57] ABSTRACT

An improvement in a cutting torch assembly that obviates the tendency to have a flashback and sustained burning immediately adjacent the point of mixing of the fuel with preheat oxygen; including cutting oxygen valve and passageway, preheat oxygen valve and passageway, fuel gas valve and passageway, a head having a tip end for having a tip affixed thereto and having a head passageway for cutting oxygen and a head passageway for the mixture of fuel and oxygen; the improvement being characterized by an integral head mixer having within the head an incoming preheat oxygen passageway and incoming fuel passageway, a mixer disposed within a well in the head and having its central bore aligned with a longitudinally extending passageway in the head and having lateral passageway penetrating through the wall of the mixer and in communication with the fuel annular space of the well, the inlet end of the bore communicating with the preheat oxygen annular space of the well such that the fuel will flow laterally through the walls of the mixer at substantially 90° so as to flow into the oxygen stream and intimately admix therewith. A holder sealingly holds the mixer in the well. Also disclosed is a theory to explain why this elegant and subtle structure is so efficacious.

4 Claims, 4 Drawing Figures

MIXER FOR CUTTING TORCH

FIELD OF THE INVENTION

This invention relates to improvements in cutting torches, either the straight cutting type or the attachment type, having a plurality of passageways for the cutting oxygen and oxygen-fuel mixture. In a particular aspect, this invention relates to an improvement in cutting torches employing integral head mixers.

DESCRIPTION OF THE PRIOR ART

In a co-pending application, Ser. No. 373,043, UTILITY TORCH HAVING HEAD MIXER, filed Apr. 29, 1982 by co-worker Roger D. Zwicker, now U.S. Pat. No. 4,409,002, assigned to the Assignee of this invention, there was described the advantages of torches generally, the variety of types of torches, including the injector type mixer in which high speed oxygen is employed to aspirate the fuel into admixture therewith before the mixture is burned to heat the metal before cutting oxygen is used; and the problems associated therewith, particularly a tendency to have sustained burning on flashback. The sustained burning burns up the torch, injures the operators; such as, the welder or the like. As noted in that application, one of the ways in which the prior art designers have attempted to eliminate flashbacks was to employ exceptionally small diameter passageways and employ a plurality of the passageways to supply, for example, oxygen and fuel gas. Other approaches included the use of heat dissipating means such as mixing spirals, spiral fins and the like. These prior art approaches are illustrated by the following U.S. Pat. Nos.: 1,262,351; 1,276,893; 2,198,342; 2,263,655; 2,371,970; 2,520,001; 3,091,281; 4,022,441; and 4,248,384.

Despite the constantly improving operability of the torches and decreasing instances of flashback in the use of either or both of the small passageways and the heat dissipating copper spirals and the like, there is still the need for a simple, economical torch having integral head mixer to alleviate the difficulties of the prior art, including sustained burning on flashback.

SUMMARY OF THE INVENTION

Accordingly, it is an object of this invention to provide a torch that obviates the tendencies to have sustained burning on flashback and the disadvantages of the prior art, yet is economical and easily manufactured without requiring the multiplicity of small diameter holes and without requiring the use of the heat dissipating devices.

It is a specific object of this invention to provide a cutting torch that has the versatility of the mixer torches with the mixers in the head, that can be operated on substantially any gaseous welding fuel yet, alleviate the difficulties with the prior art and provide an integral head type mixer with all of the advantages of the prior art.

These and other objects will become more clearly apparent from the descriptive matter hereinafter, particularly when taken into conjunction with the appended drawings.

In accordance with this invention there is provided a torch, such as a cutting torch, that obviates the tendency to have flashback and sustained burning with certain fuels, such as acetylene; yet, still achieve the flexibility theoretically inherent in integral head mixer torches. The straight cutting torch, or torch and handle combined, includes a cutting oxygen valve and passageway, a preheat oxygen valve and passageway, fuel gas valve and passageway, a head having a tip end for having a tip affixed thereto and having head passageway for cutting oxygen and a head passageway for mixture of fuel and oxygen; and have the following improvement. The improvement comprises an integral head mixer having within the head an incoming preheat oxygen passageway and an incoming fuel passageway and including a well into which the preheat oxygen and fuel passageways terminate at their discharge end; a mixer inserted within a well; the mixer having a seal intermediate the respective terminations of the preheat oxygen and preheat fuel passageways so as to separate the preheat oxygen and the fuel annular spaces, and a holder sealingly holding the mixer within the well. The head has a longitudinally extending mixture passageway for the fuel and preheat oxygen mixed together, the longitudinally extending passageway being connected with the preheat annular passageway adjacent the tip for sealingly receiving the tip with the communication between the preheat passageways. The longitudinally extending passageway is aligned with the central longitudinal axis of the well. The mixer has a substantially, cylindrical, centrally disposed bore aligned with the longitudinally extending passageway of the head and has the inlet end of the bore in communication with the preheat oxygen annular space formed by the seal on the mixer, the holder and the wall of the well. The mixer has a plurality of diameterially drilled passageways penetrating laterally therethrough and communicating respectively with the fuel annular space formed by the seal on the mixer and the wall of the well at the inlet end and at substantially 90° with respect to the central longitudinal axis of the well and with the bore on the discharge end, communicating at substantially 90° with respect to the bore. In this way, a flashback flame front extinguishes itself without sustained burning at the point of the mixing of the fuel and the preheat oxygen and without requiring expensive heat dissipating means. Respective seals such as O-rings are employed on the holder and on the mixer for sealing isolation of respective annular spaces. In the illustrated embodiment, at least two diametrally drilled passageways are drilled at substantially 90° with respect to each other and penetrate laterally through the mixer wall so as to form four short passageways that are substantially equally spaced and allow substantially immediate admixing adjacent the discharge ends of the passageways and in the bore and the longitudinally extending passageway of the head.

DESCRIPTION OF PREFERRED EMBODIMENT(S)

Figure 1:
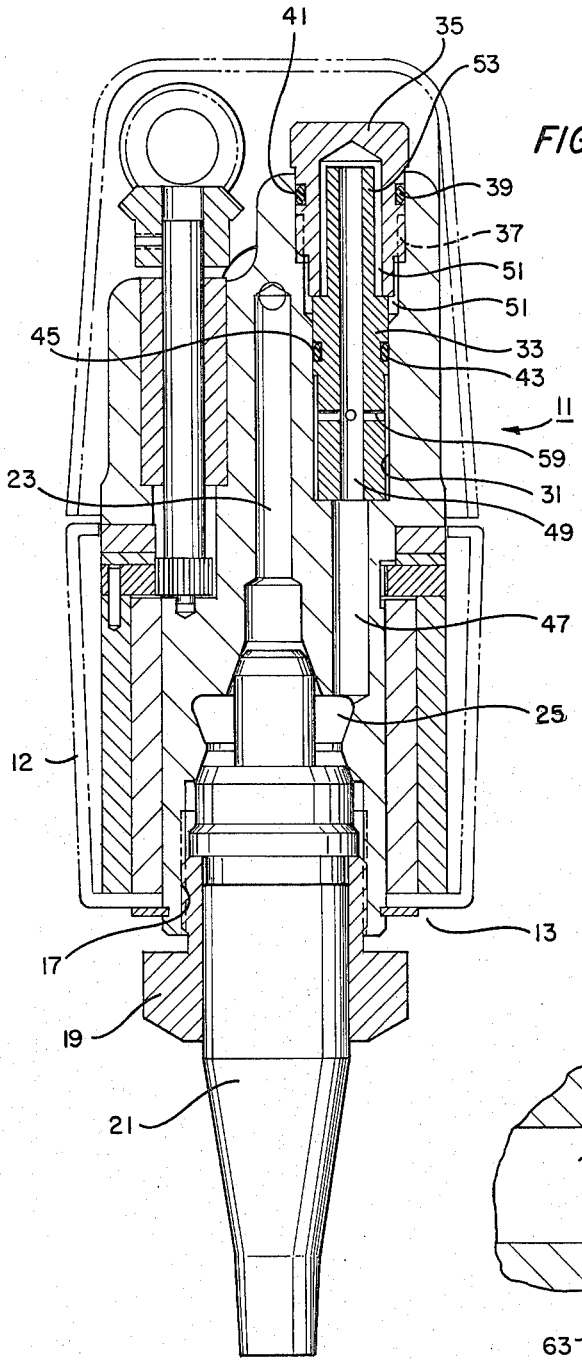
FIG. 1 is a partial cross-sectional view of one embodiment of this invention.

The improvement of this invention is useful in a wide variety of torches. For example, it can be employed in the type of torch illustrated in the aforementioned Ser. No. 373,043 and the descriptive matter and drawing of that application is incorporated herein by reference for details that are omitted herefrom. On the other hand, it can be employed in a gas cutting machine such as the subject of U.S. Pat. No. 4,014,528 and the descriptive matter of that patent is incorporated herein by reference for details that are omitted herefrom. It can be also be employed in machine torches such as employ a torch singly or employ ganged torches on a bar for cutting templates or the like. Because of this wide variety of torches with which it can be employed, the overall torch appearance is not shown in the drawings, since these torches are conventional, well known and need not be described in detail and with specificity. Typically as described in the aforementioned Ser. No. 373,043, the cutting type torch such as employed by a welder includes a torch head 11, FIG. 1, having a tip end 13 all suspended by way of a body and respective interconnecting tubes surrounded by a barrel. As is recognized and specifically described in U.S. Pat. No. 4,248,384, the contents of which are incorporated herein by reference for details that are omitted herefrom, there are usually three tubes that are integrally connected as by welding, silver soldering or the like with the head 11. The three tubes comprise a cutting oxygen tube having a cutting oxygen passageway penetrating longitudinally thereof, a preheat oxygen tube having a preheat oxygen passageway penetrating longitudinally thereof; and a fuel tube having a fuel gas passageway penetrating longitudinally thereof. Each of the tubes are also integrally affixed, as by way of welding, silver soldering or the like to a body so as to connect with respective cutting oxygen passageway having a cutting oxygen valve, a preheat oxygen passageway communicating with a preheat oxygen valve and fuel passageway communicating with a fuel valve.

Figure 2:
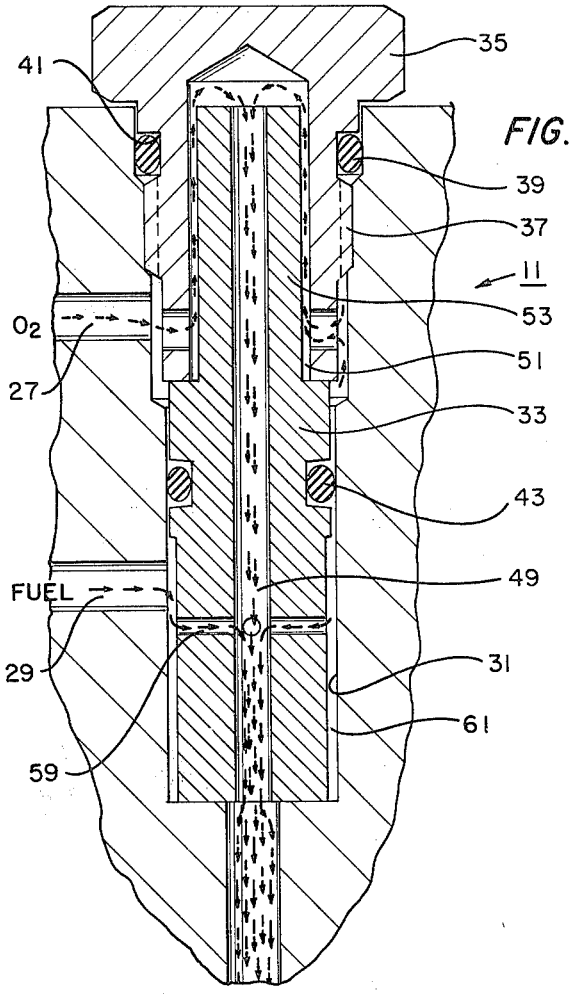
FIG. 2 is a partial cross-sectional view of the mixer inserted in the well of FIG. 1 in accordance with this invention.
Figure 3:
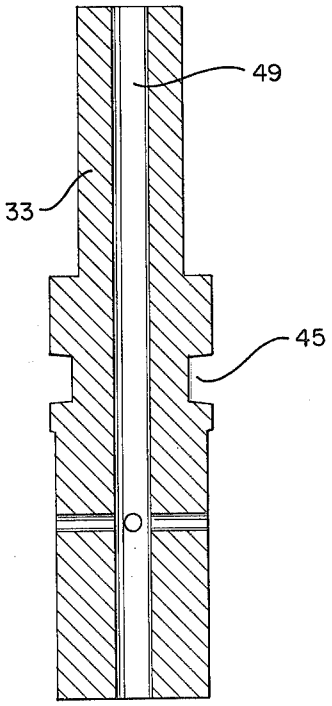
FIG. 3 is a cross-sectional view of the mixer of FIG. 2.

The torch head 11 may be of the so-called ninety degree (90°) torch head, such as employed by a welder to orient the torch tip at substantially ninety degrees to the remainder of the torch to facilitate observation of the work being performed; or it may of other orientation, such as a straight head employed in machine welding operations or the like. As illustrated, the torch head 11 has an outer shell 12 that can be easily connected with a wheel, torch or machine elements (not shown) a threaded receptacle 17 for receiving a bushing 19 for holding in place a tip 21 adjacent its tip end 13. As is also well recognized, the tip 21 will have a centrally disposed cutting oxygen passageway communicating with the cutting oxygen passageway 23 of the head 11; and a plurality of preheat mixture passageways communicating with a preheat annular chamber 25 in the head 11. Referring to FIGS 1–3, the integral head mixer 11 has within the head an incoming preheat oxygen passageway 27, FIG. 2, and an incoming fuel passageway 29. The head 11 also includes a well 31 into which the preheat oxygen and fuel passageways terminate at their discharge end; a mixer 33 inserted within the well and a holder 35 sealingly holding the mixer within the well. Specifically, the holder 35 and the well 31 have coengaging threads 37 and a seal in the form of O-ring 39 disposed intermediate smooth cylindrical walls of a respective groove and adjacent cylindrical wall. As illustrated, the groove is in the holder 35 and shown by the groove of 41. If desired, of course, the groove could be in the wall of the well 31 instead of in the holder.

Similarly, the mixer 33 that is inserted within the well 31 has a seal means in the form of the O-ring 43 that is sealingly retained in place intermediate the smooth walls of the groove and adjacent cylindrical walls. As illustrated, the groove 45 is formed in the exterior of the mixer 33 although it is relatively immaterial whether it be in the wall of the mixer or in the wall of the well 31.

The head 11 includes a longitudinally extending mixture passageway 47, FIG. 1, for the fuel and preheat oxygen mixed together. The longitudinally extending passageway 47 is connected with the preheat annular chamber 25. As indicated hereinbefore, the head 11 is adapted for sealingly receiving the tip 21 with communication between the preheat passageways of the tip and the longitudinally extending passageway 47 and the annular chamber 25. The longitudinally extending passageway 47 is aligned with the central longitudinal axis of the well 31.

Figure 4:
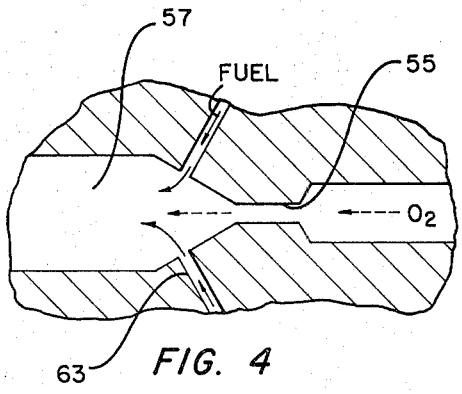
FIG. 4 PRIOR ART
FIG. 4 is a partial cross-sectional view showing the prior art arrangement for minimizing the tendency to have flashback and sustained burning at the point of the mixing of the fuel with preheat oxygen.

The mixer 33 has a central bore 49 that is substantially cylindrical and aligned with the longitudinally extending passageway of the head for reasons which will become clearer from the descriptive matter later hereinafter explaining the theory of operation of this invention. The bore has its inlet end in communication with the preheat oxygen annular space 51, as illustrated clearly in FIG. 2. This annular space for preheat oxygen is formed by separation from the fuel annular space by the seal in the form of the O-ring 43 and intermediate the wall of the well and the holder 35. The mixer 33 has a section 53 of reduced diameter so as to be retained within the holder 35 and still allow annular space for flow of the preheat oxygen upwardly in the annular space and thence into the bore 49. The bore 49 does not have any restrictions such as shown by the restriction 35 of the prior art illustrated in FIG. 4. In the embodiment of FIG. 4, the oxygen flows through at a high speed to aspirate the fuel into the mixing chamber 57, similarly as described hereinbefore.

In the embodiment of this invention, on the other hand, the short passageways 59 penetrate diametrally through the wall of the mixer 33 at substantially ninety degrees with respect to the axis of the bore as well as the axis of the annular space 61 for the fuel. Specifically, the small passageways 59 are formed by a plurality of diametrally drilled passageways penetrating laterally through the mixer 33. By this technique, a single drill passageway forms two diametrically opposite passageways. As illustrated, only two such drilled passageways are necessary to form four passageways that are disposed at substantially right angles to each other and equally spaced around the mixer 33.

By this simple and elegant invention, the problem with sustained burning on flashbacks, even if they occur, is alleviated. While the reason for the surprising efficacy of this invention is not completely clear, the following theory is offered by way of explanation and not by way of limitation. In a conventional prior art situation, the fuel mixes quickly with the oxygen at neutral settings but at high velocity oxygen, the mixing is not thorough until further downstream from the place at which the fuel enters; for example, fuel passageway 63, FIG. 4. Thus if a conventional torch is backfired the flame front returning is traveling at slow burning velocity through the unmixed gases. Since the flame front does not have enough momentum, it will not travel past the point of fuel entry and extinguish. Rather it will stop and continue to burn in the area of the fuel entry. Thus the sustained burning occurs in a conventional torch without some other means of dissipating the heat or the like. In this invention, however, fuel comes in at ninety degrees into the oxygen and mixes thoroughly even in the bore 49. Consequently, any flame front that occurs on flashback has a high velocity and is carried beyond the point of mixing and will extinguish in the rear portion of the bore in which there is only oxygen. Specifically, when this torch tip mixer is backfired a flame front travels in reverse direction of the gas flow and consists of a low pressure wave and a high pressure shock wave. Since the oxygen passage is much larger than the prior oxygen orifice 55, the pressure waves are allowed to travel to the rear of the mixer where they are reflected by the holding plug, or holder 35. When the pressure wave is reflected and reversed, it will meet another wave traveling in the opposite direction. As these waves meet, they cancel each other at a point between the fuel passageways 59 and the holder 35. Regardless of whether or not this theory is entirely accurate, this invention avoids sustained burning even if a flashback occurs and is efficacious, as well as satisfying the other objects of this invention.

Specifically, in operation, the torch is assembled as in conventional practice. In the head there will have been previously drilled the well and the mixer will be inserted with the suitable seals and passageways as described hereinbefore. In operation, the preheat flame is lit and set as desired for effecting the cutting operation. The preheat flame may be increased or decreased without regard to worsening the problems of flashback and sustained burning when this invention is employed.

This invention has deliberately omitted conventional descriptive matter such as conventional torch tips that are employed. Also, the torch tip and the torch head will be formed of corrosion resistant metallic alloys such as copper alloy, stainless steel or the like as has been done in the prior art. Similarly, the torch tubes, the body and the like will be formed of the same materials as employed in the prior art.

Also, the typical interconnection of the torch upstream fittings that are sealingly connected with respective hose connectors and hoses from high pressure regulators connected to the respective pressurized containers of high pressure oxygen and high pressure fuel gas are well known and need not be described in detail herein.

Moreover, the specific structure of typical preheat oxygen, cutting oxygen and fuel flow control valves are illustrated and described in the aforementioned Ser. No. 373,043 and may be employed in this invention.

While manually operated cutting torches are the generic form of this invention that has been described herein, cutting torch attachments having a fuel valve on a separate handle may be employed as described in U.S. Pat. No. 4,248,384. Moreover, large scale heating tips can be employed for large heating jobs as are sometimes done with cutting and torch assemblies, with automated machine torches or the like.

The specific advantages of this invention are the economically formed unit with the specifically delineated design of the respective wells, passageways and the like that are more economical than the priorly drilled torch heads with heat dissipating sprirals and the like; yet still allow an economical torch that alleviates the disadvantages and achieves the advantages of head mixer torches with very little danger of sustained burning on flashback; and can be used with a variety of fuels.

Thus it can be seen that this invention achieves the objects delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In a torch assembly that includes:

a. cutting oxygen valve and passageway;

b. preheat oxygen valve and passageway;

c. fuel gas valve and passageway; and d. a head having a tip end for having a tip affixed thereto and having head passageway for cutting oxygen and a head passageway for a mixture of fuel and oxygen;

the improvement comprising:

e. an integral head mixer having within the head an incoming preheat oxygen passageway and an incoming fuel passageway and including:

i. a well into which said preheat oxygen and fuel passageways terminate at their discharge end;

ii. a mixer inserted within said well; said mixer having a seal intermediate the respective terminations of said preheat oxygen and fuel passageways so as to form separate preheat oxygen and fuel annular spaces in said well; and iii. a holder sealingly holding said mixer within said well said head having a longitudinally extending mixture passageway for said fuel and preheat oxygen mixed together, said longitudinally extending passageway being connected with a preheat annular passageway for sealingly receiving said tip with communication between said preheat passageways therewithin; said longitudinally extending passageway being aligned with the central longitudinal axis of said well; said mixer having a substantially cylindrical, centrally disposed bore aligned with said longitudinally extending passageway of said head and having the inlet end of said bore in communication with the preheat oxygen annular space formed by said seal on said mixer, said holder and the wall of said well; said mixer having a plurality of diametrally drilled passageways penetrating laterally therethrough and communicating respectively with the fuel annular space formed by said seal on said mixer and wall of said well at the inlet end and at substantially 90° with respect to said central longitudinal axis of said well and with said bore on the discharge end, communicating at substantially 90° with respect to said bore; such that a flashback flame front extinguishes itself without sustained burning at the point of mixing of the fuel and preheat oxygen and without requiring expensive heat dissipating means.

2. The torch assembly of claim 1 wherein said seal comprises an O-ring intermediate a smooth groove wall and a smooth cylinder wall.

3. The torch assembly of claim 1 wherein said holder comprises a plug with an O-ring sealingly received intermediate a smooth groove wall and a smooth cylinder wall.

4. The torch assembly of claim 1 wherein at least two diametrally drilled passageways penetrate laterally through said mixer wall so as to form four short passageways through said wall; said four short passageways being substantially equally spaced so as to enable intimate and thorough mixing of said fuel and preheat oxygen substantially immediately adjacent the discharge ends of said passageways and in said bore and said longitudinally extending passageway of said head.

* * * * *